US005956989A

United States Patent [19]

Kusakari

[11] Patent Number: 5,956,989

[45] Date of Patent: Sep. 28, 1999

[54] WIRE TWISTING DEVICE FOR USE IN A REINFORCEMENT BINDING MACHINE

[75] Inventor: Ichiro Kusakari, Tokyo, Japan

[73] Assignee: Max Co., Ltd., Tokyo, Japan

[21] Appl. No.: 09/097,639

[22] Filed: Jun. 16, 1998

[30] Foreign Application Priority Data

Jun. 18, 1997 [JP] Japan ..... P9-161643

[51] Int. Cl.[6] ..... B21F 7/00

[52] U.S. Cl. ..... 72/119; 72/57

[58] Field of Search ..... 140/119, 57, 93 A

[56] References Cited

U.S. PATENT DOCUMENTS

| | | | |
|---|---|---|---|
| 3,786,841 | 1/1974 | Albrecht et al. | 140/119 |
| 4,117,872 | 10/1978 | Gott et al. | 140/57 |
| 4,160,469 | 7/1979 | Joannic | 140/115 |
| 4,865,087 | 9/1989 | Geiger | 140/119 |
| 5,020,355 | 6/1991 | Payne et al. | 140/57 |
| 5,279,336 | 1/1994 | Kusakari et al. | 140/57 |

FOREIGN PATENT DOCUMENTS

| | | |
|---|---|---|
| 0 751 269 A1 | 1/1997 | European Pat. Off. . |
| 9-13679 | 1/1997 | Japan . |
| 2552385 | 7/1997 | Japan . |

*Primary Examiner*—Joseph J. Hail, III
*Assistant Examiner*—Susan R. Kingsbury
*Attorney, Agent, or Firm*—Morgan, Lewis & Bockius LLP

[57] ABSTRACT

For use in a reinforcement binding machine, a wire twisting device is disclosed in which the stroke thereof is extended and the reliability of the operation thereof is thereby improved. A compression spring 34 and a flanged pin 35 which is mounted on a screw shaft 32 are inserted into a cylinder portion 33*a* formed in the rear end face of a shaft 33 provided in a wire twisting device 31, and the screw shaft 32 and shaft 33 are connected together by a removal prevention ring 36. The shaft 33 is structured such that it is free to rotate and can be moved back and forth in the axial length range of the flange pin 35. A pair of hook levers 39 are pivotally mounted on the front portion of a sleeve 38 connected to a sleeve nut 37, and the guide grooves 39*a* of the hook levers 39 are respectively engaged with a guide pin 41 provided in the front portion of the shaft 33. As the sleeve 38 is moved forward, the shaft 33 is also moved forward by a given distance, while the hook levers 39 are respectively moved forward by a given distance with the spread-open state thereof remaining unchanged and, subsequently, the hook levers 39 are switched into their closing operations, which makes it possible to expand the wire holdable range of the wire twisting device.

16 Claims, 4 Drawing Sheets

WIRE TWISTING DEVICE FOR USE IN A REINFORCEMENT BINDING MACHINE

BACKGROUND OF THE INVENTION

The present invention relates to a wire twisting device for use in a reinforcement binding machine and, in particular, to a wire twisting device for use in a reinforcement binding machine which is improved in reliability.

A reinforcement binding machine is generally well-known as a machine for binding reinforcements at their mutually intersecting positions thereof in a reinforcement arranging process in a reinforcement concrete construction work. FIG. 3 shows a conventional reinforcement binding machine 1 including a housing 2 in which a wire feed device 3 and a wire twisting device 4 are incorporated. On the side surface (in FIG. 3, the side surface is situated on the deep or far side of the sheet thereof) of the rear portion of the housing 2, there is pivotally and rotatably mounted a reel base (not shown) on which a wire reel can be mounted.

A feed roller 5, which is included in the wire feed device 3 and can be driven or rotated by a motor (not shown), supplies a wire wound around the wire reel through a guide pipe 6 to an arc-shaped nose portion 7 which is formed in the front portion of the reinforcement binding machine 1.

The wire twisting device 4 is used to bind a wire W which is wound around reinforcements R by the wire feed device 3, while the wire twisting device 4 drives or rotates a screw shaft 10, which is connected to a motor 8 through a reduction gear 9, in both forward and reverse directions.

As shown in FIG. 4, a slotted shaft 11 disposed coaxially with the screw shaft 10 is rotatably connected to the leading end of the screw shaft 10 by a flanged pin 12 and a removal preventive ring 13, while a guide pin 14 extending at right angles to the axis of the shaft 11 is provided on the leading end portion of a slot 11*a* formed in the shaft 11.

A sleeve nut 15 is mounted on the outside surface of the screw shaft 10 and, further, a sleeve 16 is fixed to the outer periphery of the sleeve nut 15. And, on the outer peripheral surface of the rear portion of the sleeve 16, there is arranged a rotation preventive fin 17 which is formed long in the axial direction thereof and extends in the radial direction of the sleeve 16. A pair of hook levers 18 are pivotally mounted on the two sides of the neighborhood of the leading end portion of a slot 16*a* formed in the front portion of the sleeve 16, in such a manner that they are opposed to each other with the shaft 11 between them. Guide grooves 18*a* which extend in the radial direction of the hook levers when viewed from the rotation shafts of the hook levers 18 are formed in the respective inner portions of the hook levers 18, while the guide grooves 18*a* are engaged with the guide pin 14 provided on the shaft 11.

The pair of hook levers 18 respectively include leading end hook portions 18*b*. And, the leading end hook portions 18*b* of the hook levers 18, when they are held in their wait/ready states, spread open and face forward. When the sleeve nut 15 and sleeve 16 are moved or slid forward on the shaft 11, the guide pin 14 is then moved backwardly or retreats with respect to the sleeve 16 and the inside portions of the hook levers 18 are thereby pulled backward, with the result that the leading end hook portions 18*b* of the two hook levers 18 are rotated in their mutually approaching directions and are finally made to cross each other.

The wire twisting device 4 is structured such that it takes its wait/ready position when the sleeve nut 15 and sleeve 16 are rotated 90° from their positions shown in FIG. 3 and the pair of hook levers 18 are thereby moved to their horizontally held conditions and, in this wait/ready position, the wire loop W can be gripped from the two sides thereof, that is, from the left and right sides thereof.

The wire feed device 3 and wire twisting device 4 can be sequence controlled by a control circuit (not shown) and, by pulling a trigger 19 provided in the grip portion 2*a* of the housing 2 shown in FIG. 3, the wire feed device 3 and wire twisting device 4 are allowed to execute one cycle operation which consists of a wire feed step and a wire twisting step.

In operation, if the trigger 19 is pulled, then a wire feed motor (not shown) is firstly actuated to rotate the feed roller 5, thereby feeding the wire W to the nose portion 7; and, the wire W is curved in an arc manner along the shape of a guide groove formed in the inner periphery of the nose portion 7 and is then wound around the peripheries of the reinforcements R in a loop manner. If a given number of windings of the wire W are finished, then the wire feed motor is caused to stop and, following this, the motor 8 of the wire twisting device 4 is started.

FIG. 4 shows the twisting operation of the wire twisting device 4. At the wait/ready position of the wire twisting device 4 shown in FIG. 4 (*a*), a rotation prevention pawl 20 is in engagement with the rotation prevention fin 17 of the sleeve 16 and, therefore, the sleeve nut 15, sleeve 16 and shaft 11, respectively are kept against rotation.

And, in this state, if the screw shaft 10 is driven or rotated counterclockwise when viewed from the motor 8 side (in FIG. 4(*a*), the right side), then the sleeve nut 15 and sleeve 16 are moved forward in an integral manner. As shown in FIGS. 4(*b*), (*c*) and (*d*), at the same time when the sleeve 16 starts to move forward, the hook levers 18 are respectively rotated in their closing directions due to the cam actions of the guide pin 14 and guide grooves 18*a* to thereby grip the wire loop and, after then, as shown in FIG. 4(*e*), the hook levers 18 cross each other completely. And, due to the forward movement of the sleeve 16, the fin 17 of the sleeve 16 is removed from the engagement with the rotation prevention pawl 20, thereby allowing the sleeve nut 15, sleeve 16 and shaft 11 to rotate together with the screw shaft 10, with the result that the wire loop gripped by the hook levers 18 can be twisted and bound.

After then, a rotary type of shearing device 21, which is provided in the wire path of the nose portion 7 shown in FIG. 3, is driven to thereby cut the wire within the nose portion 7 and, at the same time, the motor 8 is reversed to thereby move back the sleeve nut 15 and sleeve 16, so that the hook levers 18 are spread open to thereby release the wire; and, the wire twisting device 4 returns back to the wait/ready position.

Because the wire W used in the above-mentioned reinforcement binding machine is wound around the reel, the outer peripheral portion of the wire W and the inner peripheral portion of the wire W are different in the winding curvature from each other. Therefore, when the wire W is drawn out from the nose portion 7, the curvature of the wire W is caused to vary due to such different winding curvatures of the outer and inner peripheral portions of the wire W. That is, at the time when the wire W is used initially, there is formed a wire loop of a relatively large diameter but, as the wire W is consumed, the diameters of the wire loops decrease sequentially and gradually. The loop diameter is also caused to vary depending on the tensile strength of the wire itself. A wire having a high tensile strength provides a large loop diameter.

The wire twisting device 4 is structured to have a back-and-forth stroke which allows the hook levers 18 to grip the wire loop even when the loop diameter varies to a certain degree. However, when the above-mentioned causes of loop diameter variance combine together, the curvature of the wire played out from the nose portion 7 can be excessively large, which may cause the leading end of the wire to collide with the leading end portion of the shaft 11. When such collision occurs, the running path of the wire can be deviated from too greatly to form a loop.

On the other hand, if the whole of the wire twisting device 4 is displaced backward in position in order to prevent the occurrence of such collision between the wire and the leading end face of the shaft 11, then there is raised a fear that, when the loop diameter of the wire decreases, the leading ends of the hook levers 18 are not able to reach the wire and thus they are unable to grip the wire loop.

Thus, there arises a technical problem which must be solved in order to improve the reliability of the conventional reinforcement binding machine.

SUMMARY OF THE INVENTION

Accordingly, it is an object of the invention to provide a wire twisting device for use in a reinforcement binding machine which is able to wind a wire around reinforcements positively regardless of differences in the winding diameters and tensile strengths of wires.

The above object can be attained by a wire twisting device for use in a reinforcement binding machine according to the present invention, said wire twisting device in which a sleeve is loosely fitted with a shaft, slots are respectively formed in the respective leading end portions of the shaft and sleeve, a guide pin is provided in the slot of the shaft, a pair of hook levers are pivotally mounted in the slot of the sleeve, guide grooves formed in the hook levers are respectively engaged with the guide pin, thereby forming a hook lever opening and closing mechanism, the sleeve is driven to move forward to thereby rotate the hook levers in their mutually closing directions, a wire wound around the peripheries of reinforcements by a wire feed device is gripped by the hook levers and, after then, the sleeve and shaft are driven or rotated integrally to thereby bind the wire, wherein the shaft having the guide pin is mounted on the leading end of a screw shaft included in a feed screw mechanism consisting of the present screw shaft and a sleeve nut in such a manner that the shaft can be rotated freely and can be freely slid in a given range, the shaft is also energized in its extending direction by a spring, the sleeve loosely fitted with the shaft is connected to the sleeve nut, and extension restriction means for restricting the extension of the shaft is provided in a slide portion consisting of the sleeve nut, sleeve and hook levers, so that, when the slide portion retreats to its backward wait/ready position, the shaft can be restricted to its contraction position by the present extension restriction means; and, also in that, while the sleeve and sleeve nut are kept from rotating by a rotation prevention mechanism, the screw shaft is rotationally driven to thereby move the slide portion back and forth, when moving the slide portion forward, the positional restriction of the shaft is removed and the shaft is thus moved forward by a given distance to thereby delay the start timing of the closing operation of the hook levers, the rotation prevention of the sleeve and sleeve nut is removed after the wire is gripped by the hook levers, and the screw shaft and the slide portion are rotated integrally to thereby bind the wire.

In addition, the above-mentioned object can also be attained by a wire twisting device for use in a reinforcement binding machine comprising:

a shaft having a guide pin formed at a leading end portion thereof;

a feed screw shaft which is rotatably coupled with the shaft, is movably coupled with the shaft within a predetermined distance in an axial direction thereof, and is integrally coupled with the shaft when the feed screw shaft and the shaft are relatively moved more than the predetermined distance;

a sleeve nut threadedly engaged with the feed screw shaft in such a manner that the sleeve is moved in the axial direction when the feed screw shaft is rotated, the sleeve nut having a fin formed on the outer periphery thereof;

a sleeve integrally coupled with the sleeve nut and having a pair of pivot pins at the leading end thereof;

a pair of hook levers for gripping a wire, the hook levers being pivotally and respectively mounted on the pivot pins while guide grooves formed in the hook levers are respectively engaged with the guide pin; and a rotation preventive mechanism brought in slidably engagement with the fin for preventing the sleeve nut from rotating relative to the feed screw shaft, in which the hook levers are kept in an opened state when the feed screw shaft is only moved relative to the sleeve in the axial direction, and the hook levers are stated to rotate into a close state when the feed screw shaft integrally together with the shaft are moved relative to the sleeve in the axial direction.

The above-mentioned construction of the wire twisting device according to the present invention, advantageously, further comprising:

an urging means interposed between the shaft and the screw shaft for urging the shaft relative to the screw shaft in the axial direction.

In addition, in the above-mentioned construction of the wire twisting device according to the present invention, advantageously, the screw shaft comprises a flanged pin having a pin portion and a flange integrally formed with the pin at the leading end thereof, and the shaft comprises a cylinder portion slidably engaged with the flange portion and a removal preventive ring which is disposed on a basal end of the shaft for preventing the flanged portion from removing from the cylinder portion, the removal preventive ring being provided with an opening which is slidably engaged with the pin portion.

Further, in the above-mentioned construction of the wire twisting device according to the present invention, advantageously, the length of the pin portion, in slidable contact with the inner periphery of the openings is longer than the thickness of the removal preventive ring in the axial direction.

Furthermore, the above-mentioned construction of the wire twisting device according to the present invention, advantageously, further comprises:

an urging means, e.g., a spring interposed between the shaft and the screw shaft for urging or biasing the shaft away from the screw shaft in the axial direction.

Moreover, in the above-mentioned construction of the wire twisting device according to the present invention, advantageously, the urging means comprises a coil spring disposed within the cylinder portion.

Still moreover, in the above-mentioned construction of the wire twisting device according to the present invention, advantageously, each of the hook levers comprises a restricting portion for restricting an opening angle between the hook levers.

DETAILED DESCRIPTION OF THE PREFERRED EMBODIMENTS

Figure 1:
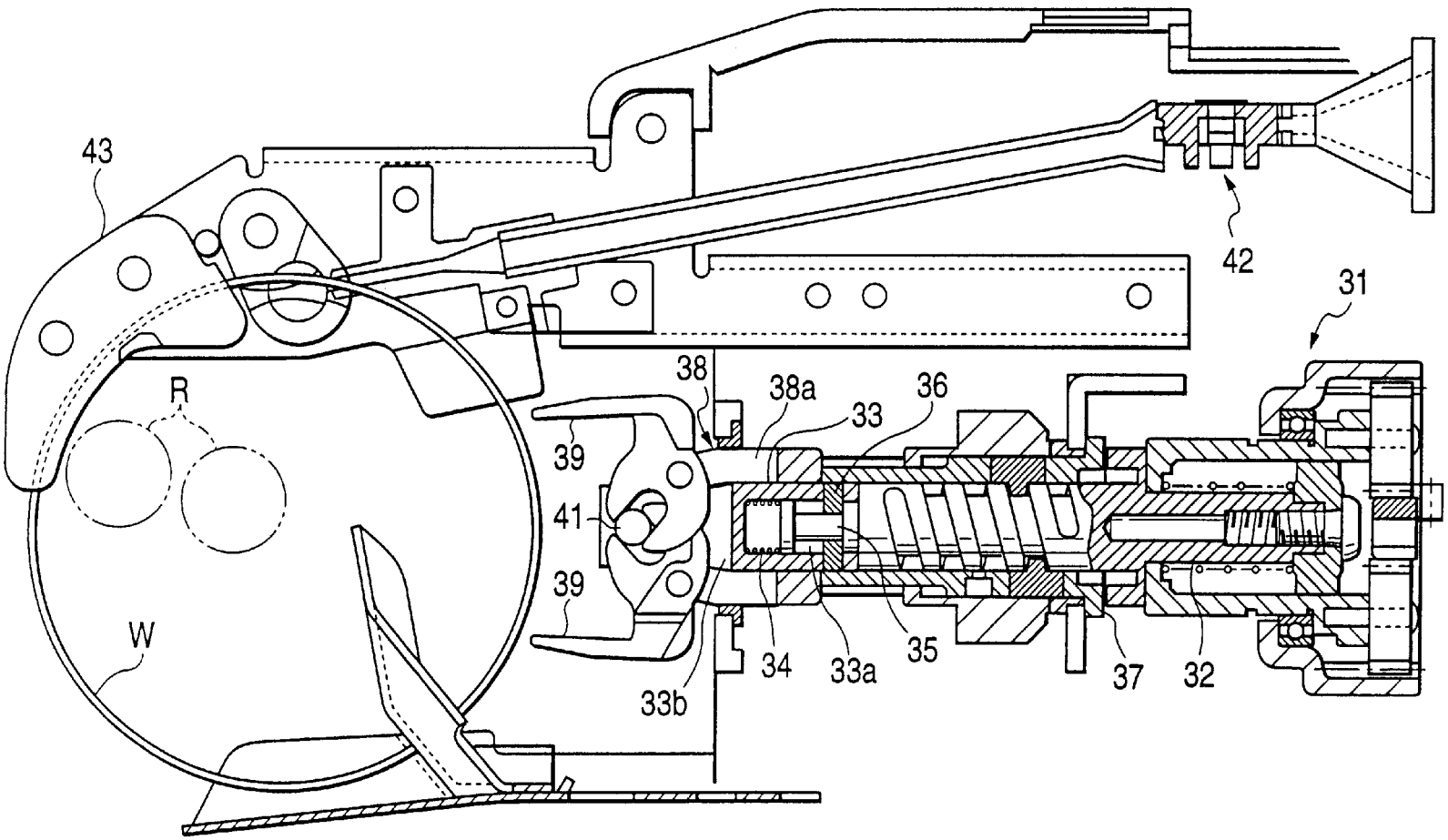
FIG. 1 is a section view of the main portions of a reinforcement binding machine incorporating therein a wire twisting device according to an embodiment of the invention.

Now, description will be given below of an embodiment of a wire twisting device for use in a wire binding machine according to the invention with reference to the accompanying drawings. FIG. 1 shows a wire twisting device 31 for use in a wire binding machine. The wire twisting device 31 is different from the above-mentioned conventional wire twisting device 4 in a connecting structure for connecting a screw shaft 32 and a slotted shaft 33.

In the present connecting structure, a compression spring 34 and the head portion of a flanged pin 35 (which is composed of a pin portion 35*b* and a flange portion 35*a*) fixedly secured to the leading end face of the screw shaft 32 are inserted into a cylinder portion 33*a* from behind, while the cylinder portion 33*a* is formed in the rear portion of the shaft 33, and a removal preventive ring 36 having an opening 36*a* is fitted into the rear portion of the shaft 33, thereby being able to connect the screw shaft 32 and shaft 33 to each other.

The flanged pin 35 used here has an axial length which is longer by 3.5 mm than the axial length of the conventional flanged pin. The shaft 33 connected to the screw shaft 32 is free to rotate and can be moved back and forth with respect to the screw shaft 32 in the range of 3.5 mm. In a wait/ready state shown in FIG. 1, the shaft 33 is situated at the rear end of the movable range thereof; in particular, the shaft 33 is situated at a position which is displaced backward by 3.5 mm from the conventional shaft 11 shown in FIG. 3.

Figures 2A, 2B, 2C, 2D, 2E:
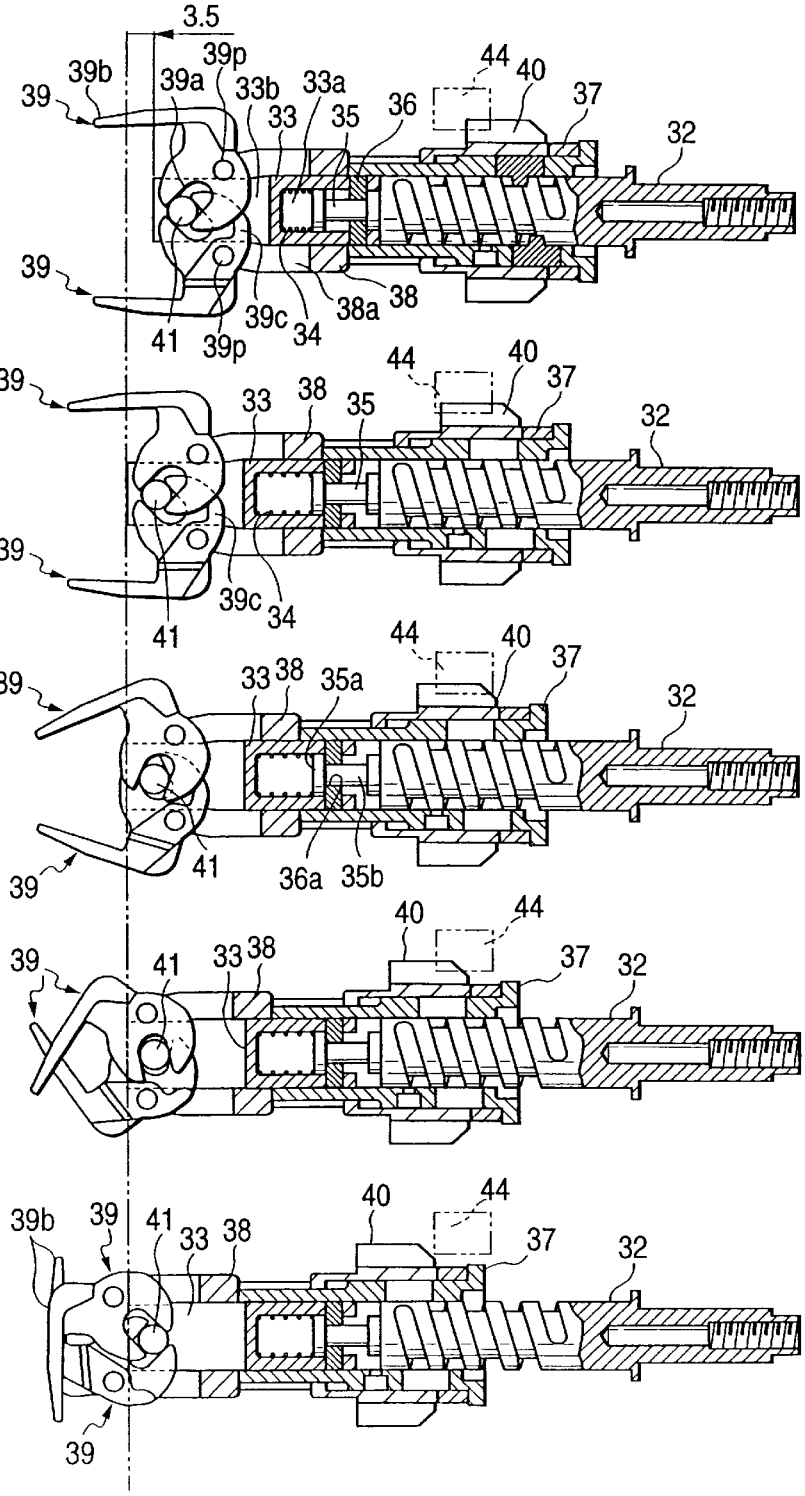
FIG. 2 is a section view of the wire twisting device shown in FIG. 1, showing the flow of the operations thereof.
Figure 3:
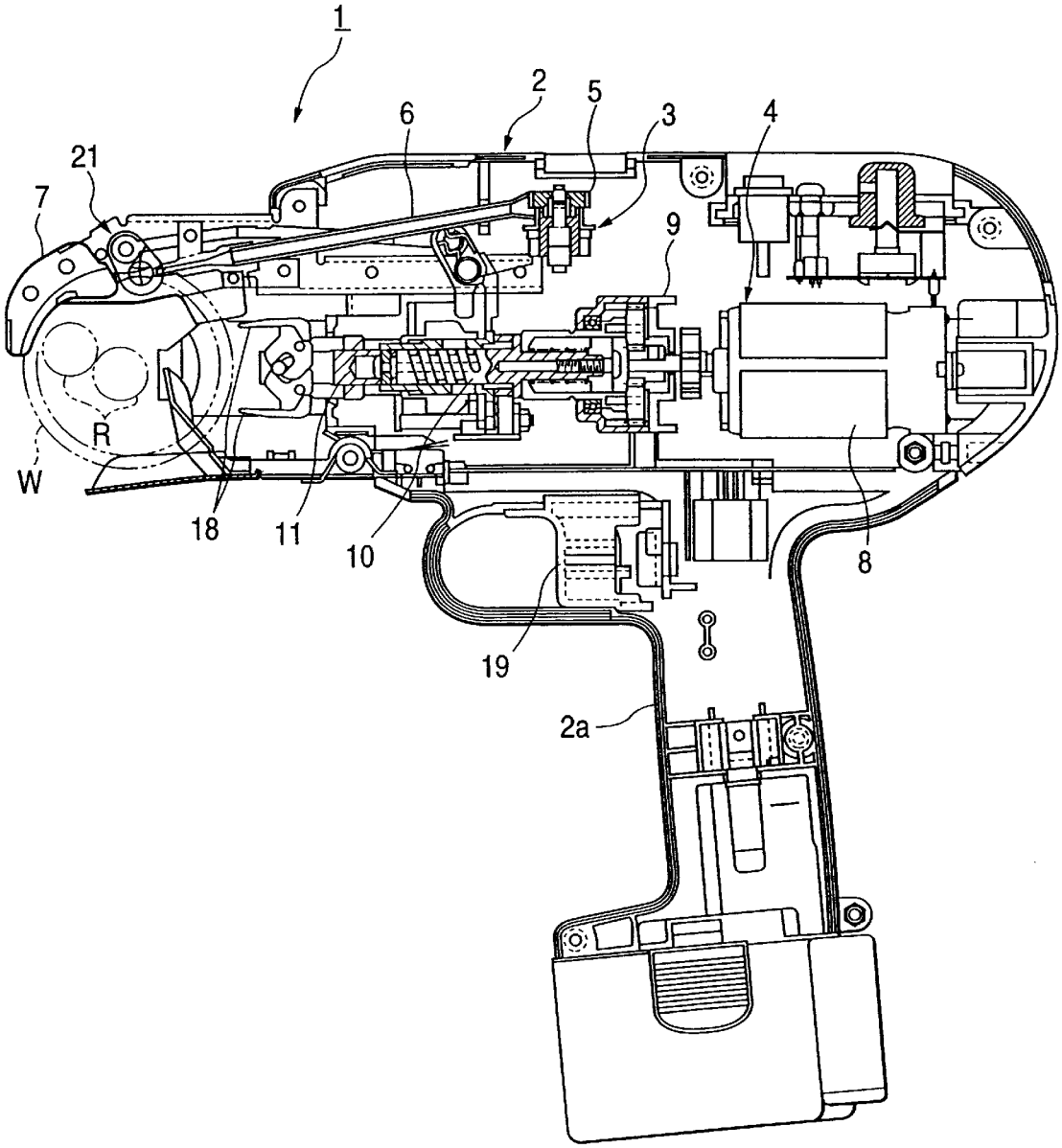
FIG. 3 PRIOR ART
FIG. 3 is a section view of the main portions of a reinforcement binding machine incorporating therein a conventional wire twisting device.
Figure 4A:
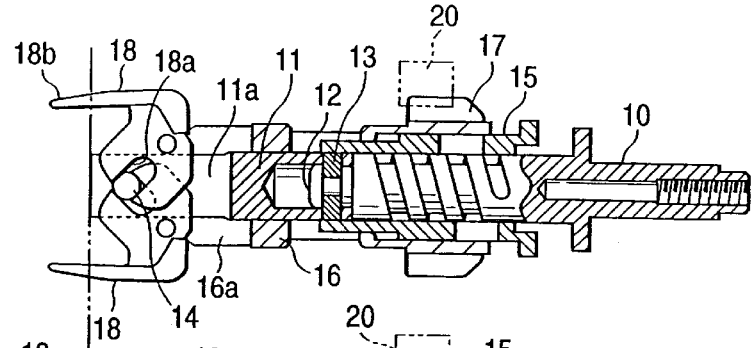
PRIOR ART FIG. 4(a)
FIG. 4 is a section view of the conventional wire twisting device shown in FIG. 3, showing the flow of the operations thereof.
Figure 4B:
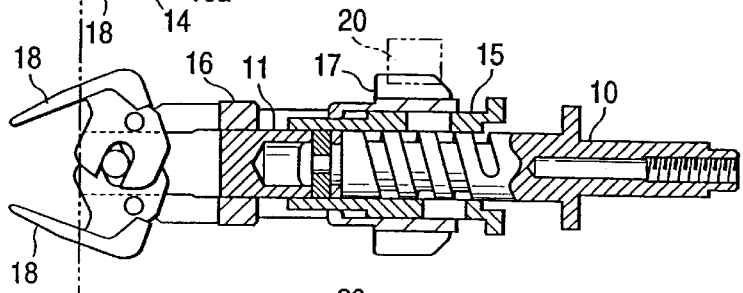
PRIOR ART FIG. 4(b)
Figure 4C:
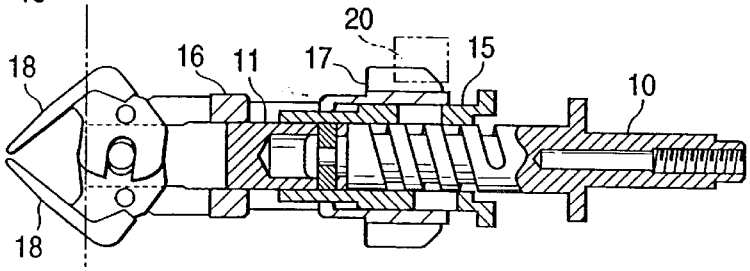
PRIOR ART FIG. 4(c)
Figure 4D:
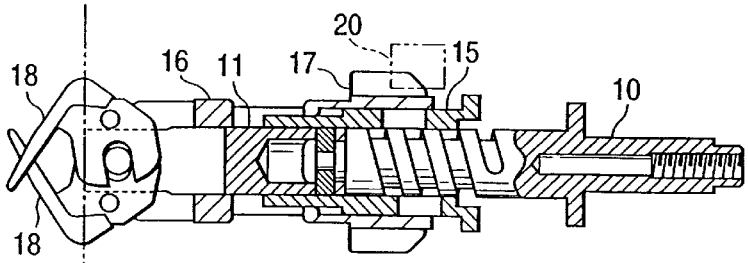
PRIOR ART FIG. 4(d)
Figure 4E:
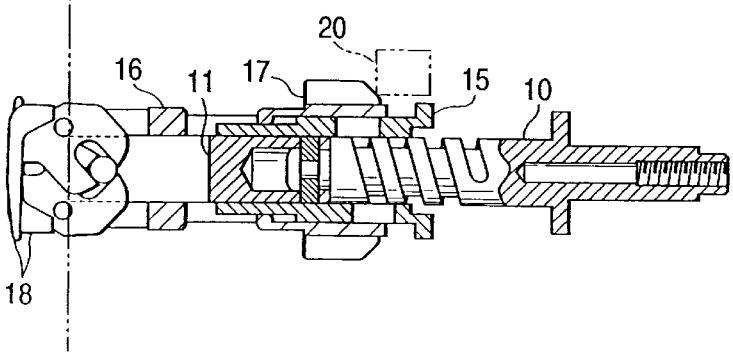
PRIOR ART FIG. 4(e)

The other portions of the present reinforcement binding machine than the screw shaft 32 and shaft 33 connecting portion are the same as those of the reinforcement binding machine 1 shown in FIG. 3: that is, as shown in FIG. 2, a sleeve nut 37 is mounted on the outer surface of the screw shaft 32 and, further, a sleeve 38 is fixed to the outer periphery of the sleeve nut 37. A rotation prevention fin 40 is so arranged as to extend radially on the outer peripheral surface of the rear portion of the sleeve 38, in the neighborhood of the leading end portion of a slot 38*a* formed in the front portion of the sleeve 38, a pair of hook levers 39 are pivotally mounted at pivot pins 39*p* in such a manner that they are opposed to each other with the shaft 33 between them, and guide grooves 39*a* respectively formed in the inner portions of the hook levers 39 and extending in the radial direction thereof are respectively engaged with a guide pin 41 which is disposed in a slot 33*b* formed in the shaft 33.

Also, in FIG. 2, the back surface portion 39*c* of the lower-side hook lever 39 is larger in thickness than the portion of the guide groove 39*a* thereof; that is, when the upper- and lower-side hook levers 39 are spread open to their respective wait/ready states, the back surface portion 39*c* of the lower-side hook lever 39 is butted against the back surface portion of the upper-side hook lever 39 to stop the spreading of the hook levers 39, thereby being able to limit the spreading angle of the hook levers 39.

Similar to the conventional wire twisting device 4, the wire twisting device 31 takes its wait/ready position when the sleeve nut 37 and sleeve 38 are rotated by 90° from the positions shown in FIG. 1 and the pair of hook levers 39 are thereby made to extend horizontally.

Next, description will be given below of the operation of the wire twisting device 31. At first, a wire is fed by a wire feed device 42 and is then played out from the nose portion 43 of the reinforcement binding machine. In this case, since the wire twisting device 31 is situated at a position displaced backward by 3.5 mm from the conventional wire twisting device, even if the curvature of the wire W exceeds the set range of the curvature to a certain degree, the leading end of the wire W does not collide with the leading end portion of the shaft 33 but passes between the pair of hook levers 39 and turns a given number of times around the peripheries of reinforcements R, so that a wire loop can be formed positively.

After the wire loop is formed, the operation of the wire feed device 42 is stopped, in the wait/ready position shown in FIG. 2(*a*), the motor (not shown) of the wire twisting device 31 is actuated, and the screw shaft 32 is driven or rotated counterclockwise when viewed from the motor side (in FIG. 2, from the right side). As a result of this, as shown in FIG. 2(*b*), the sleeve nut 37 and sleeve 38 are moved forward and the shaft 33 is also moved forward due to the energizing force of the compression spring 34 in linking with the sleeve nut 37 and sleeve 38. Therefore, since the position relation between the hook levers 39 pivotally mounted on the sleeve 38 and the guide pin 42 of the shaft 33 remains unchanged, the hook levers 39 are moved forward while maintaining their open condition.

When the shaft 33 is moved forward by 3.5 mm, as shown in FIG. 2(*b*), the removal preventive ring 36 is butted against the flange of the flanged pin 35 but the screw shaft 32 continues to rotate and, as shown in FIGS. 2(*c*) and (*d*), the sleeve nut 37 and sleeve 38 are further moved forward. At that time, the hook levers 39, which are in engagement with the guide pin 41 of the shaft 33, are respectively started to rotate in their mutually closing directions due to the cam actions between the guide pin 41 and guide grooves 39*a*, and, as shown in FIG. 2(*e*), finally, the leading end hook portions 39*b* of the hook levers 39 are made to cross each other, thereby being able to grip the loop of the wire between them. At the same time, similar to the conventional wire twisting device, the engagement between the fin 40 of the sleeve 38 and the rotation preventive pawl 44 is removed, and the sleeve nut 37, sleeve 38 and shaft 33 are rotated together with the screw shaft 32, so that the wire gripped by and between the two hook levers 39 can be twisted and bound.

After the wire is bound, the motor is rotated reversely and the sleeve nut 37 and sleeve 38 are thereby put into their retreating steps, so that the hook levers 39 are spread open in the order of FIGS. 2(*e*), (*d*), and (*c*); and, when the hook levers 39 respectively arrive at the positions shown in FIG. 2(*b*), the back surface portion 39*c* of the lower-side hook lever 39 is butted against the back surface portion of the upper-side hook lever 39, thereby causing the hook levers 39 to stop their rotational movements in their spreading directions, while the sleeve nut 37 and sleeve 38 retreat further. Due to such retreating movements of the sleeve nut 37 and sleeve 38, the guide pin 41 of the shaft 33 is pushed backward by the hook levers 39, so that the shaft 33 retreats while compressing the compression spring 34. As a result of this, the present wire twisting device returns to the wait/ready position shown in FIG. 2(*a*).

As described above, the wire twisting device 31 is structured such that, when the sleeve 38 with the hook levers 39 pivotally mounted thereon is moved forward from the wait/ready position, the shaft 33 for opening and closing the hook levers 39 is moved forward by a given distance together with the sleeve 38 and, after the shaft 33 is moved forward by a given distance with the hook levers 39 spread open, the shaft 33 is switched into its closing step. Due to this structure, the back-and-forth stroke of the wire twisting device 31 can be extended without increasing the diameter of the sleeve 38 or extending the lengths of the hook levers 39. And, the wait/ready position of the present wire twisting device 31 is displaced more backward by a distance corresponding to the extension of the stroke thereof than the conventional twisting device, which can prevent an accident such as when the leading end of the wire played out from the nose portion collides with the leading end portion of the shaft to thereby make it impossible to bind the wire.

The invention is not limited to the above-mentioned embodiment but various changes and modifications are possible without departing from the technical scope of the invention, and, of course, the invention includes such changes and modifications.

As has been described heretofore, in a wire twisting device for use in a reinforcement binding machine according to the invention, since the back-and-forth stroke of the wire twisting device is extended to increase the wire loop holdable range thereof and the wait/ready position thereof is displaced backward by a distance equivalent to such extension, even when the curvature of a wire played out from the nose portion thereof exceeds a specified range to a certain degree, the wire can be prevented from colliding with the shaft of the wire twisting device and thus the wire can be positively wound around the peripheries of the reinforcements to form a loop regardless of differences in the winding diameters and tensile strengths of wires, thereby being able to improve the reliability of the binding operation of the reinforcement binding machine.

While there has been described a preferred embodiment of the invention, it will be obvious to those skilled in the art that various changes and modifications may be made therein without departing from the invention, and it is the aim, therefore, to cover in the appended claims all such changes and modifications as fall within the true spirit and scope of the invention.

What is claimed is:

1. A wire twisting device for use in a reinforcement binding machine comprising:

a shaft (33) having a guide pin formed at a leading end portion thereof;

a feed screw shaft (32) which is coupled with said shaft (33) such that said shaft (33) can rotate with respect to said feed screw shaft (32) and can move a predetermined distance in an axial direction thereof with respect to said feed screw shaft (32);

a sleeve nut (37) threadedly engaged with said feed screw shaft (32) in such a manner that said sleeve is moved in the axial direction when said feed screw shaft (32) is rotated, said sleeve nut (37) having a fin (40) formed on the outer periphery thereof, a sleeve (38) integrally coupled with said sleeve nut (37) and having a pair of pivot pins (39*p*) at the leading end thereof;

a pair of hook levers (39) for gripping a wire, each of said hook levers being pivotally mounted on a respective one of said pivot pins and engaged by said guide pin (41) so that axial movement of said sleeve (38) with respect to said shaft (33) rotates said hook levers (39); and a rotation prevention mechanism (44) in slidable engagement with said fin for preventing said sleeve nut (37) from rotating relative to said feed screw shaft (32), in which said hook levers are kept in an opened state when said feed screw shaft (32) is located within said predetermined distance away from said shaft (33) and said sleeve (38) moves in conjunction with said shaft (33), and said hook levers rotate into a closed state when said shaft (33) is axially fixed with respect to said feed screw shaft (32) at said predetermined distance and said sleeve (38) moves axially with respect to said shaft (33).

2. The wire twisting device for use in a reinforcement binding machine according to claim 1, further comprising:

urging means (34) interposed between said shaft (33) and said screw shaft (32) for urging said shaft (33) away from said screw shaft (32) in the axial direction.

3. The wire twisting device for use in a reinforcement binding machine according to claim 1, in which said screw shaft (32) comprises a flanged pin (35) having a pin portion (35*b*) and a flange (35*a*) integrally formed with said pin at the leading end thereof, and said shaft (33) comprises a cylinder portion (33*a*) slidably engaged with said flange portion (35*a*) and a removal prevention ring (36) which is disposed on a basal end of said shaft (33) for preventing said flanged portion from removing from said cylinder portion (33*a*), said removal prevention ring (36) being provided with an opening (36*a*) which is slidably engaged with said pin portion (35*b*).

4. The wire twisting device for use in a reinforcement binding machine according to claim 3, further comprising:

urging means (34) interposed between said shaft (33) and said screw shaft (32) for urging said shaft (33) away from said screw shaft (32) in the axial direction.

5. The wire twisting device for use in a reinforcement binding machine according to claim 4, in which said urging means (34) comprises a coil spring (34) disposed within said cylinder portion.

6. The wire twisting device for use in a reinforcement binding machine according to claim 1, in which the length of said pin portion (35) in slidable contact with the inner periphery of said openings (36*a*) is longer than the thickness of the removal prevention ring (36) in the axial direction.

7. The wire twisting device for use in a reinforcement binding machine according to claim 1, in which each of said hook levers comprises:

a restricting portion (39*c*) for restricting an opening angle between said hook levers.

8. A wire twisting device for use in a reinforcement binding machine, comprising:

a sleeve having a slot formed in a leading end portion of said sleeve;

a shaft located in said sleeve and having a slot formed in a leading end portion of said shaft;

a guide pin provided in the slot of the shaft;

a pair of hook levers pivotally mounted in the slot of the sleeve, said hook levers including guide grooves engaged with the guide pin, thereby forming a hook lever opening and closing mechanism, whereby when the sleeve is driven to move forward to thereby rotate the two hook levers in their closing directions, a wire wound around the peripheries of reinforcements by a wire feed device can be gripped by and between the two hook levers and the sleeve and shaft can be subsequently driven or rotated integrally to thereby bind the wire;

wherein said shaft (33) having said guide pin (41) is mounted on the leading end of a screw shaft (32) included in a feed screw mechanism that includes said screw shaft (32) and a sleeve nut (37) in such a manner that said shaft (33) can be rotated freely and can be freely slid in a given range, said shaft (33) also being energized in its extending direction by a spring (34), said sleeve (38) located in said shaft (33) is connected to said sleeve nut (37) and said sleeve and sleeve nut are kept from rotating in conjunction and simultaneously with said screw shaft by a rotation prevention mechanism (40,44), said screw shaft (32) can be rotationally driven to thereby move said sleeve nut, sleeve and hook levers back and forth, and when moving said sleeve nut, sleeve and hook levers forward said shaft (33) can be simultaneously and in conjunction with said screw shaft moved forward by a given distance to thereby delay the start of the closing operation of said hook levers (39), the rotation prevention mechanism permits said sleeve and sleeve nut to rotate in conjunction and simultaneously with said screw shaft after said wire is gripped by said hook levers to thereby bind said wire.

9. The wire twisting device for use in a reinforcement binding machine according to claim 8, wherein said sleeve nut, sleeve and hook levers can move back and forth between a predetermined backward wait/ready position and a fully extended position, and said sleeve nut, sleeve and hook levers are configured such that when they reach said predetermined backward wait/ready position, said shaft (33) is prevented from movement by the configuration of said sleeve nut, sleeve and hook levers.

10. A wire twisting device for use in a reinforcement binding machine, comprising:

a screw member;

a sleeve member engaged with said screw member to move axially with respect to said screw member when said screw member is rotated with respect to said sleeve member;

a shaft rotatably attached to said screw member and coupled for relative axial movement with respect to said screw member along a first predetermined distance;

first and second hooks pivotally mounted to said sleeve member and engaged with said shaft for rotational movement between an opened position and a closed position; and a rotation prevention mechanism engageable with said sleeve member to prevent said sleeve member from rotating with to said screw member over said first predetermined distance, whereby rotation of said screw member advances said sleeve member and said shaft with respect to said screw member for said first predetermined distance, advances said sleeve with respect to said shaft and screw member over a second predetermined distance thereby rotating said hooks to said closed position, and disengages said rotation prevention mechanism from said sleeve member after said sleeve member advances with respect to said shaft and screw member over said second predetermined distance to permit said sleeve member and hooks to rotate and twist wire engaged by said hooks.

11. The wire twisting device for use in a reinforcement binding machine as claimed in claim 10, further comprising:

a spring located between said shaft and said screw shaft.

12. The wire twisting device for use in a reinforcement binding machine as claimed in claim 10, further comprising:

a flanged pin located between said shaft and said screw shaft and including a cylinder portion and a flange portion.

13. A method for twisting wire using a wire twisting device that includes a screw shaft, a shaft mounted adjacent to said screw shaft for axial movement relative to said screw shaft, a sleeve member mounted to said screw shaft for axial movement relative to said screw shaft, hook levers mounted to said sleeve and rotatable between an opened position and a closed position, and a wire feed device, said method comprising the steps of:

feeding wire from the wire feed device around an object that is to be bound by wire;

driving the screw shaft while preventing rotation of the sleeve member, thus advancing the shaft forward a given distance while holding the hook levers in the opened position;

closing the hook levers about the wire after the shaft has traveled said given distance and as the screw shaft is continued to be driven; and rotating the hook levers and screw shaft as one, thus rotating the closed hook levers and twisting the wire.

14. The method of twisting wire as claimed in claim 13, wherein said step of closing the hook levers includes advancing said sleeve member in an axial direction with respect to said shaft and said screw shaft as said screw shaft is continued to be driven.

15. The method of twisting wire as claimed in claim 13, further comprising:

opening the hook levers after the wire has been twisted; and preventing the hook levers from opening beyond said fully opened position.

16. The method of twisting wire as claimed in claim 15, further comprising:

retracting said hook levers, sleeve member and shaft along an axial distance towards the screw shaft after the hook levers have been opened to said fully opened position.

* * * * *

UNITED STATES PATENT AND TRADEMARK OFFICE

CERTIFICATE OF CORRECTION

PATENT NO. : 5,956,989
APPLICATION NO. : 09/097639
DATED : September 28, 1999
INVENTOR(S) : Ichiro Kusakari It is certified that error appears in the above-identified patent and that said Letters Patent is hereby corrected as shown below:

In the Claims

Column 9, line 60, Claim 10, between “with” and “to”, add --regard--.

Signed and Sealed this
Twenty-ninth Day of September, 2015

Michelle K. Lee

Michelle K. Lee
*Director of the United States Patent and Trademark Office*